US011721167B2

(12) United States Patent
Huang

(10) Patent No.: US 11,721,167 B2
(45) Date of Patent: Aug. 8, 2023

(54) SYSTEM AND METHOD FOR FACILITATING A CARD GAME

(71) Applicant: Zhen Hui Huang, Macau (CN)

(72) Inventor: Zhen Hui Huang, Macau (CN)

( * ) Notice: Subject to any disclaimer, the term of this patent is extended or adjusted under 35 U.S.C. 154(b) by 267 days.

(21) Appl. No.: 17/244,207

(22) Filed: Apr. 29, 2021

(65) Prior Publication Data

US 2021/0256800 A1 Aug. 19, 2021

Related U.S. Application Data

(63) Continuation-in-part of application No. 16/861,252, filed on Apr. 29, 2020, now abandoned, and a continuation-in-part of application No. 16/290,339, filed on Mar. 1, 2019, now abandoned, which is a continuation-in-part of application No. 16/144,010, filed on Sep. 27, 2018, now abandoned.

(60) Provisional application No. 62/702,010, filed on Jul. 23, 2018.

(51) Int. Cl.
*G07F 17/32* (2006.01)
*A63F 3/00* (2006.01)

(52) U.S. Cl.
CPC ..... *G07F 17/3227* (2013.01); *G07F 17/322* (2013.01); *G07F 17/3216* (2013.01); *G07F 17/3248* (2013.01); *G07F 17/3293* (2013.01); *A63F 2003/00164* (2013.01)

(58) Field of Classification Search
CPC ..... G07F 17/322; G07F 17/3248; A63F 2003/00164
See application file for complete search history.

(56) References Cited

U.S. PATENT DOCUMENTS 8,961,296 B2 * 2/2015 Walker ..... G07F 17/322 463/21
2010/0093428 A1 * 4/2010 Mattice ..... G07F 17/3239 463/25
2010/0285869 A1 * 11/2010 Walker ..... G07F 17/3251 463/16
2010/0304841 A1 * 12/2010 Sammon ..... G07F 17/3251 463/25
2014/0018137 A1 * 1/2014 Flaherty ..... G07F 17/3276 463/11
2018/0185741 A1 * 7/2018 Shigeta ..... G07F 17/322
2018/0357850 A1 * 12/2018 Moore ..... G07F 17/3211
2021/0256800 A1 * 8/2021 Huang ..... G07F 17/3293

* cited by examiner

*Primary Examiner* — Corbett B Coburn
(74) *Attorney, Agent, or Firm* — Muncy, Geissler, Olds & Lowe, P.C.

(57) ABSTRACT

A gaming system includes a table having at least one betting area, at least one camera, at least one antenna and a processing device. The camera captures an image of the betting area, and the antenna receives a signal from at least one RFID-enabled betting chip. The processing device analyzes the image and the signal to identify a value and identity of chips, to calculate a total value of bets based on a sum of the chip values, and to determine authenticity of a chip. A method for playing a modified Baccarat card game includes providing a gaming table having various betting options, receiving one or more Variable Value Tokens from a gambler, determining whether the wager placed in the stage of receiving is a winning wager in the Baccarat game and on the Bigger Win side bet and other side bets (if any), and dispensing a payout.

20 Claims, 7 Drawing Sheets

| | Face value | Counts | Sum |
|---|---|---|---|
| White(C1) | 10,000 | 5 | 50,000 |
| Blue(C2) | 5,000 | 2 | 10,000 |
| Green(C3) | 1,000 | 3 | 3,000 |
| Total | | | 63,000 |

| | Face value | Counts | Sum |
|---|---|---|---|
| White(C1) | 10,000 | 2 | 20,000 |
| Blue(C2) | 5,000 | 3 | 15,000 |
| Green(C3) | 1,000 | 3 | 3,000 |
| Total | | | 38,000 |

SYSTEM AND METHOD FOR FACILITATING A CARD GAME

CROSS REFERENCE TO RELATED APPLICATIONS

This application is a continuation-in-part of U.S. patent application Ser. No. 16/290,339, filed on Mar. 1, 2019 continuation-in-part of U.S. patent application Ser. No. 16/144,010, filed on Sep. 27, 2018 which claims priority to U.S. Provisional Application No. 62/702,010 filed on Jul. 23, 2018, and this application claims priority as a continuation-in-part to U.S. patent application Ser. No. 16/861,252 filed on Apr. 29, 2020, the disclosure of each of which is incorporated herein by reference its entirety.

TECHNICAL FIELD

The present invention relates to gaming systems, and in particular a system and method for facilitating a casino card game, including embodiments of a modified Baccarat game.

BACKGROUND

In casinos, a player typically exchanges currency or some form of credit for casino chips. The player puts the chips as wagers at a gaming table for a game, such as blackjack, craps, roulette, or baccarat. A game operator, such as a dealer, pays out winning wagers with additional chips based on a game rule of the game, and confiscates the player's chips for losing wagers. However, there is currently no system that can efficiently obtain information on the use of chips. Thus, there is a need for a new gaming system to overcome the said problems.

Among casino games, Baccarat is an example of a popular casino game, including a popular version known as punto banco Baccarat. The standard rules of Baccarat generally include the use of established rules with the object of getting closest to a point total of 9. Based on the established rules, cards are dealt first to the "player," then to the "banker," then to the player (if necessary) and then to the banker (if necessary). The outcomes are player win, banker win, or a "tie." These outcomes allow for a natural as a point value of either 8 or 9 with the first two cards used.

Many versions of modified Baccarat games have been developed. For example, U.S. Pat. No. 8,573,597 discloses a method of playing Baccarat including a side bet, which has a payout based on an occurrence of a natural 8-count or 9-count that loses if either no natural occurs, or bettors chose a side that did not have a natural. U.S. Pat. No. 5,362,064 also discloses a Baccarat game with side bets, including a specific side bet where a natural tie pays 50:1. U.S. Pat. Nos. 6,789,801 and 5,395,119 are other examples of Baccarat games offering side bets. However, there remains a need for a further improved Baccarat game and for systems and methods of facilitating a card game.

BRIEF SUMMARY OF THE INVENTION

The present invention provides a gaming system, comprising: a table, at least one camera, and a processing device. The table has at least one betting area. The camera captures an image of the betting area. The processing device analyzes the image to identify each pile of chips based on diameters of the chips, to identify each chip from the identified piles of chips based on heights of the chips, to identify a chip value of each of the identified chips based on color, and to calculate a total value of bets based on a sum of the chip values. Since the camera is provided to calculate the total value of bets and the chip box has RFID reader to identify the authenticity of chips, the gaming system can efficiently obtain information on the use of chips. Further embodiments include a Baccarat game incorporating the gaming system.

DETAILED DESCRIPTION

Figure 1:
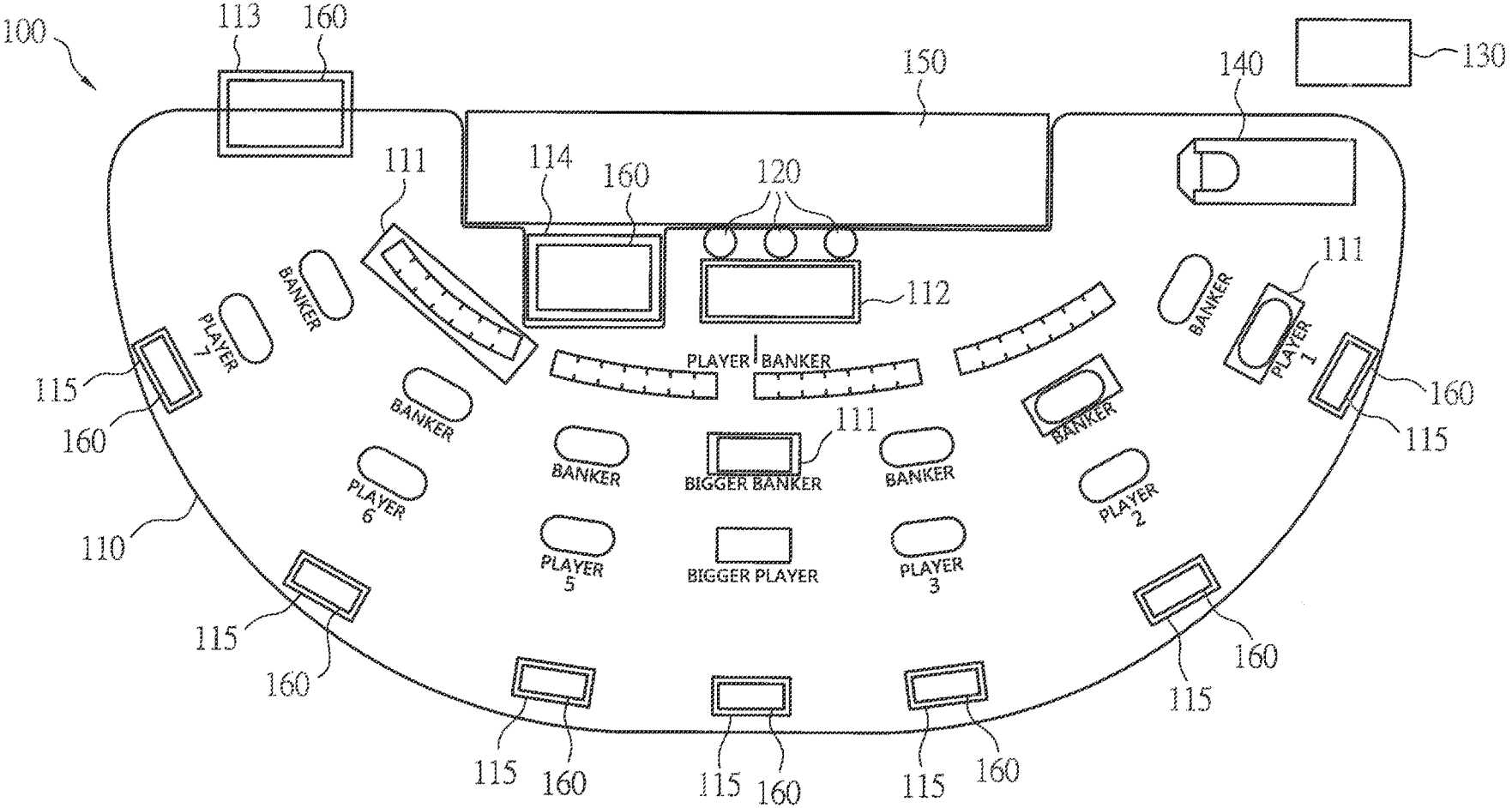
FIG. 1 illustrates a gaming system according to an embodiment of the present invention.

FIG. 1 illustrates a gaming system according to an embodiment of the present invention. As illustrated in FIG. 1, the gaming system 100 comprises a table 110, at least one camera 120, a processing device 130, a card shoe 140 and a chip tray 150. In some embodiments, the gaming system 100 further comprises a plurality of monitors 160. Specifically, the table 110 has at least one betting area 111, a sensor area 112 and at least one display area, wherein the display area can be in a supervisor position 113, a dealer position 114 and/or at least a player position 115. Note that the numbers of the betting area 111, the sensor area 112 and the display area all can't be limited to these shown in FIG. 1, e.g., their numbers can depend on the needs of the games. The camera 120 is coupled to the processing device 130 and captures one or more image of the betting area 111 and then sends the image to the processing device 130. In some embodiments, the camera 120 can be disposed on the table 110 and/or the ceiling of the house, but it is not limited thereto. The camera 120 can be disposed on any position where the camera 120 is capable to capture the image of the betting area 111. In addition, the number of the camera 120 can't be limited to this shown in FIG. 1, e.g., it can depend on the needs of the games.

The processing device 130 receives the image from the camera 120 and then analyzes the image to identify each pile of chips based on diameters of the chips, to identify each chip from the identified piles of chips based on heights of the chips, to identify a chip value of each of the identified chips based on color, and to calculate a total value of bets based on a sum of the chip values. Specifically, the processing device 130 can draw virtual lines on the betting areas based on the heights (or thicknesses) of chips to determine how many chips in each pile of chips in the betting area 111 on the table 110. The processing device 130 can draw virtual areas on the betting areas based on the diameters of the chips to determine how many piles of chips on the table 110. Furthermore, the processing device 130 determines a chip value of a chip based on a color of the chip itself. In some embodiments, the processing device 130 further recognizes face values printed on the chips based on the image to determine a chip value of each of the chips. Therefore, the processing device 130 capable to determine a chip value of each chip based on the height, diameter and color and then sums up all of the chip values to calculate total value of bets. Before a game session starts, the cameras 120 will capture the images of the chips and then send the captured image to the processing device 130 to count chip values of each betting area. The gaming system 100 has default application programmable interfaces (APIs) for the card shoe 140 to call, this is, to start, hold and end a game session. The processing device 130 is capable to record bets, win and lose of each player at each game session. Once cards are played on the sensor area 112, the cameras 120 and the processing device 130 will stop calculating. When the dealer ends a game, the processing device 130 will record and compare the payouts based on the game rule. If the processing device 130 determines that the payouts mismatch game rules through the camera 120, the processing device 130 will send alerts to system managers, and hold a game session until the gaming system 100 clears the alerts. Once the payouts are deployed correctly, then the card shoe 140 will be able to start a new game and deliver cards.

In various implementations, the processing device 130 may be a laptop, a netbook, a notebook, a smartphone, a tablet, a personal digital assistant (PDA), an ultra-mobile PC, a mobile phone, a desktop computer, a server, a printer, a scanner, a monitor, a set-top box, an entertainment control unit, a digital camera, a portable music player, a digital video recorder, or any other electronic device or system that processes data or employs one or more integrated circuit structures or devices formed using the disclosed techniques, as variously described herein.

Figure 2:
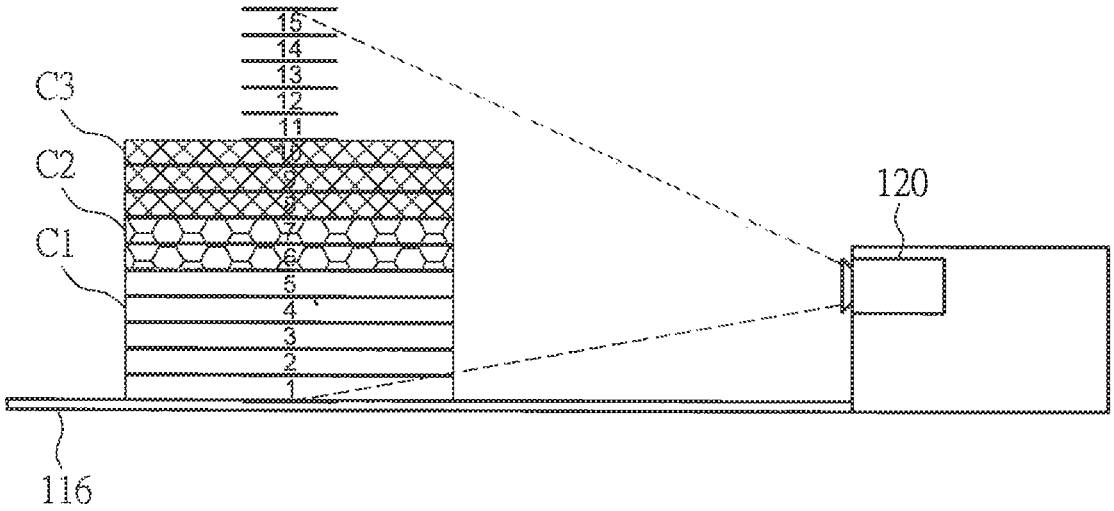
FIG. 2 illustrates a schematic side view of a gaming system according to an embodiment of the present invention.

In FIG. 1, the plurality of monitors 140 are disposed in the supervisor position 113, the dealer position 114 and/or the player position 115 on the table 110 to display the chip counts and the chip values. The cameras 120 aim each the betting areas. FIG. 2 illustrates a schematic view wherein a camera is arranged for a side view, in a gaming system according to an embodiment of the present invention. In the side view, the chips are set with different face value and color (e.g., the chip C3 (green)=1000; the chip C2 (blue)=5000; and the chip C1 (white)=10000). The processing device 130 draws virtual lines starting from the surface 116 of the table 110 on the image based on the height of one chip and recognizes colors of each chip. After the recognition, the processing device 130 counts number of each color and thus calculates sum of the total chip. In FIG. 2, the processing device 130 recognizes that there are five white chips (the face value is 10000), two blue chips (the face value is 5000) and three green chips (the face value is 1000) on the table 110 and sums up all of the face values of the chips to generate a total value of bets (the total value is 63000).

Figure 3:
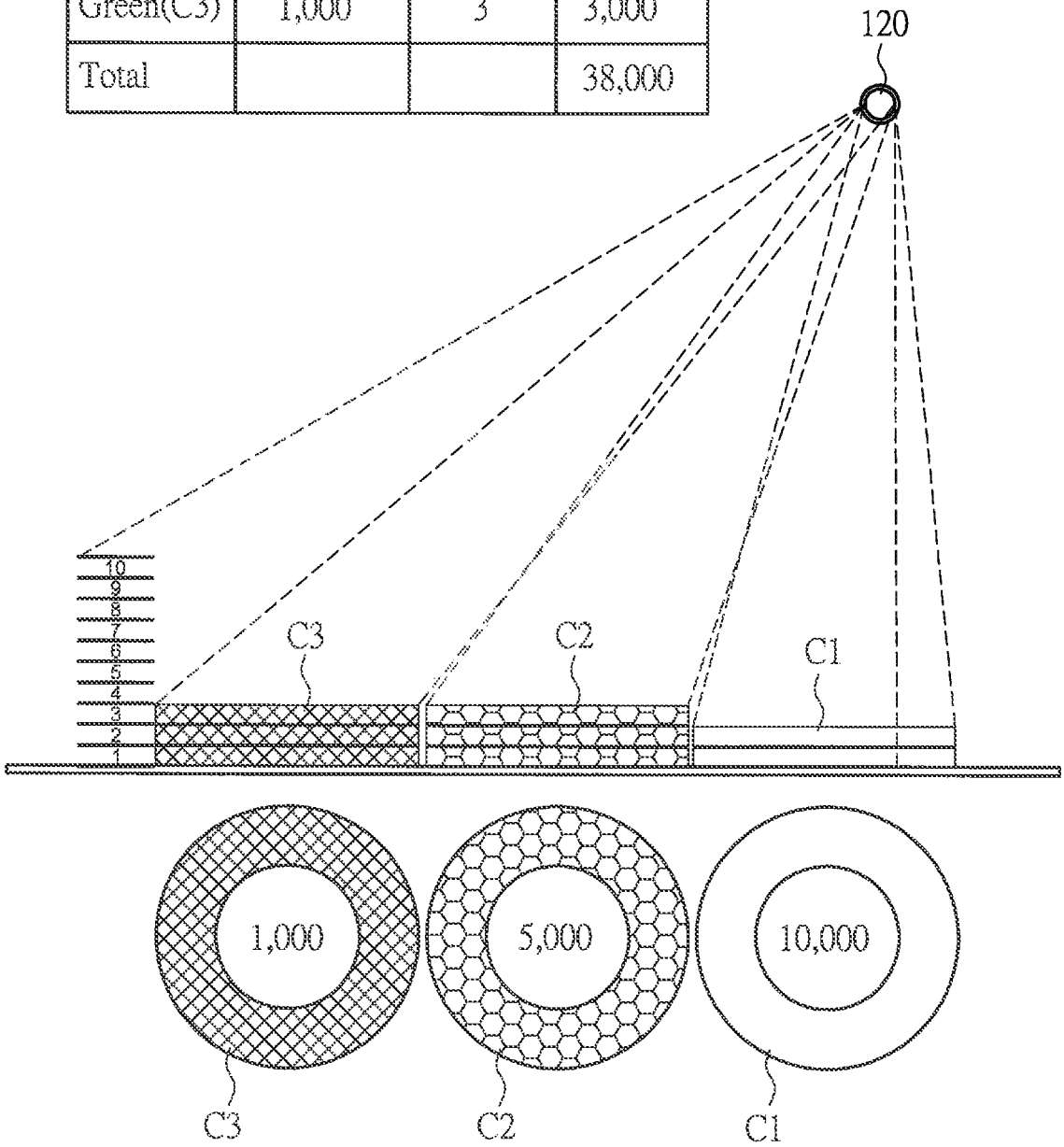
FIG. 3 illustrates a schematic bird's-eye view of a gaming system according to an embodiment of the present invention.

FIG. 3 illustrates a schematic view wherein a camera is arranged for a bird's-eye view, in a gaming system according to an embodiment of the present invention. In the bird's-eye view, the chips are set with different face value and color (e.g., the chip C3 (green)=1000; the chip C2 (blue)=5000; and the chip C1 (white)=10000). The processing device 130 draws virtual lines starting from the surface 116 of the table 110 on the image based on the height of one chip. The processing device 130 further draws virtual circles based on the diameter of one chip and recognizes colors of each chip. In some embodiments, the processing device 130 recognizes face value printed on the chips based on the image. After the recognition, the processing device 130 counts numbers of each color and thus calculates sum of the total chip. In FIG. 3, the processing device 130 recognizes that there are two white chips (the face value is 10000), three blue chips (the face value is 5000) and three green chips (the face value is 1000) on the table 110 and sums up all of the face values of the chips to generate a total value of bets (the total value is 38000).

Figure 4A:
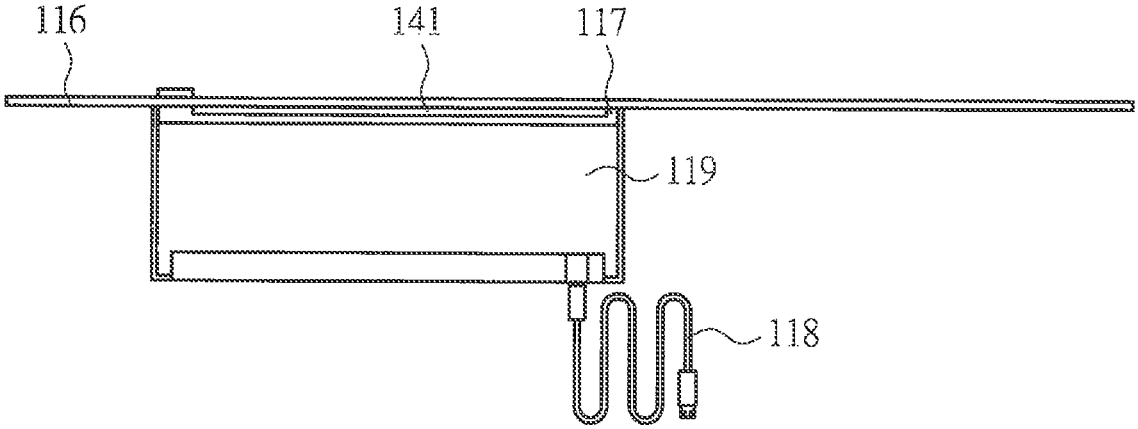
FIGS. 4A and 4B illustrate a cross-sectional view of a docking hole according to an embodiment of the present invention.
Figure 4B:
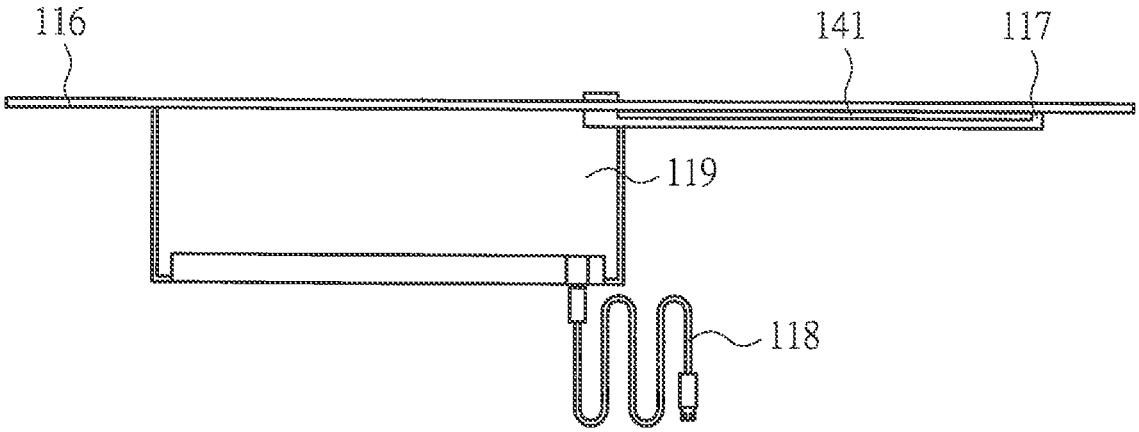

FIGS. 4A and 4B illustrate a cross-sectional view of a docking hole according to an embodiment of the present invention. The table 110 is designed to have docking holes 119 at each player positions 115 (shown in FIG. 1). The docking holes 119 are embedded with metal cases sinking below the surface 116 of the table 110. The docking holes 119 are embedded with a wireless communication system to report player information. Moreover, the table 110 is designed to have slide-in lids 117 each over the corresponding docking holes 119. The slide-in lids 117 each can be slid to expose the docking holes 119. The table 110 is designed to have a wire harness 118 in each docking hole 119 to provide wired and/or wireless charging and network connectivity. Optionally, one or more of the monitors 140 embedded on the tops of the slide-in lids 117 at the player position 115 can be an interactive panel 141. The interactive panel 141 is coupled to the processing device 130 and embedded with a customized software that (1) displays player information, player status, game status and/or game rules; (2) displays game table status, wherein the embedded software will call card shoe APIs to read, record, and display game results; (3) displays chip counts and values received from the camera 120 and the processing device 130; (4) connects to a chip box to read chip values, wherein the chip box has a RFID (Radio Frequency IDentification) reader for this purpose; and/or (5) connects to the chip box to detect whether there is a false chip, wherein the processing device 130 is coupled to a chip box that has a RFID reader to read chip values and detect a false chip. Furthermore, the interactive panel 141 is embedded with the customized software that connects to processing device 130 to call service such as an accounting service and/or a table service.

Since the camera 120 is provided to calculate the total value of bets and the chip box has RFID reader to identify the authenticity of chips, the gaming system 100 can efficiently obtain information on the use of chips. In addition, since the docking holes 119 are provided on the surface 116 of the table 110 for the placement of the chip box, the wired and/or wireless charging, and the network connectivity, the gaming system 100 increases player comforts. Moreover, the interactive panel 141 over the docking hole 119 can encourage players to increase spending on additional services.

Figure 5:
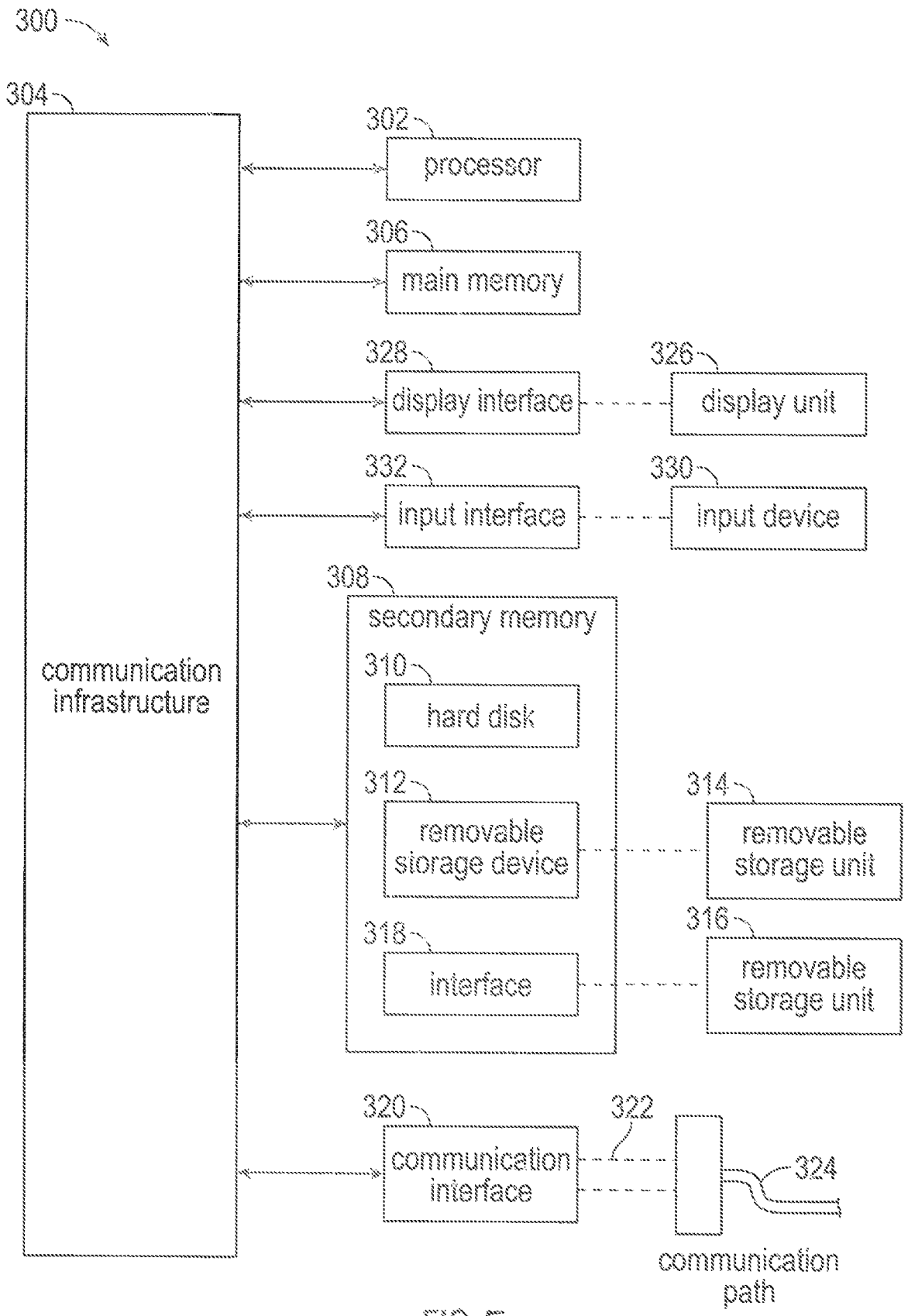
FIG. 5 is a block diagram of an example computer system in which disclosed embodiments may be implemented as computer-readable code, in accordance with an embodiment of the present disclosure.

FIG. 5 is a block diagram of a computer system 300, which may be exemplary of or in communication with processing device 130, in which disclosed embodiments of, or portions thereof, may be implemented as computer-readable code (i.e., machine-readable computer program instructions), which is executed by one or more processors causing the one or more processors to perform operations of the disclosed embodiments, according to an embodiment.

Disclosed systems may include components implemented on computer system 300 using hardware, software, firmware, tangible computer-readable (i.e., machine-readable) media having computer program instructions stored thereon, or a combination thereof, and may be implemented in one or more computer systems or other processing system.

If programmable logic is used, such logic may be executed on a commercially available processing platform or a on a special purpose device. One of ordinary skill in the art may appreciate that embodiments of the disclosed subject matter can be practiced with various computer system configurations, including multi-core multiprocessor systems, minicomputers, mainframe computers, computers linked or clustered with distributed functions, as well as pervasive or miniature computers that may be embedded into virtually any device.

Various disclosed embodiments are described in terms of this example computer system 300. After reading this description, persons of ordinary skill in the relevant art will know how to implement disclosed embodiments using other computer systems and/or computer architectures. Although operations may be described as a sequential process, some of the operations may in fact be performed in parallel, concurrently, and/or in a distributed environment, and with program code stored locally or remotely for access by single or multi-processor machines. In addition, in some embodiments the order of operations may be rearranged without departing from the spirit of the disclosed subject matter.

As persons of ordinary skill in the relevant art will understand, a computing device for implementing disclosed embodiments has at least one processor, such as processor 302, wherein the processor may be a single processor, a plurality of processors, a processor in a multi-core/multi-processor system, such system operating alone, or in a cluster of computing devices operating in a cluster or server farm. Processor 302 may be connected to a communication infrastructure 304, for example, a bus, message queue, network, or multi-core message-passing scheme.

Computer system 300 may also include a main memory 306, for example, random access memory (RAM), and may also include a secondary memory 308. Secondary memory 308 may include, for example, a hard disk drive 310, removable storage drive 312. Removable storage drive 312 may include a floppy disk drive, a magnetic tape drive, an optical disk drive, a flash memory, or the like. The removable storage drive 312 may be configured to read and/or write data to a removable storage unit 314 in a well-known manner. Removable storage unit 314 may include a floppy disk, magnetic tape, optical disk, etc., which is read by and written to, by removable storage drive 312. As will be appreciated by persons of ordinary skill in the relevant art, removable storage unit 314 may include a computer readable storage medium having computer software (i.e., computer program instructions) and/or data stored thereon.

In alternative implementations, secondary memory 308 may include other similar devices for allowing computer programs or other instructions to be loaded into computer system 300. Such devices may include, for example, a removable storage unit 316 and an interface 318. Examples of such devices may include a program cartridge and cartridge interface (such as that found in video game devices), a removable memory chip (such as EPROM or PROM) and associated socket, and other removable storage units 316 and interfaces 318 which allow software and data to be transferred from the removable storage unit 316 to computer system 300.

Computer system 300 may also include a communications interface 320. Communications interface 320 allows software and data to be transferred between computer system 300 and external devices. Communications interfaces 320 may include a modem, a network interface (such as an Ethernet card), a communications port, a PCMCIA slot and card, or the like. Software and data transferred via communications interface 320 may be in the form of signals 322, which may be electronic, electromagnetic, optical, or other signals capable of being received by communications interface 320. These signals may be provided to communications interface 320 via a communications path 324.

In this document, the terms "computer program storage medium" and "computer usable storage medium" are used to generally refer to storage media such as removable storage unit 314, removable storage unit 316, and a hard disk installed in hard disk drive 310. Computer program storage medium and computer usable storage medium may also refer to memories, such as main memory 306 and secondary memory 308, which may be semiconductor memories (e.g., DRAMS, etc.). Computer system 300 may further include a display unit 326 that interacts with communication infrastructure 304 via a display interface 328. Computer system 300 may further include a user input device 330 that interacts with communication infrastructure 304 via an input interface 332. A user input device 330 may include a mouse, trackball, touch screen, or the like.

Computer programs (also called computer control logic or computer program instructions) are stored in main memory 306 and/or secondary memory 308. Computer programs may also be received via communications interface 320. Such computer programs, when executed, enable computer system 300 to implement embodiments as discussed herein. In particular, the computer programs, when executed, enable processor 302 to implement the processes of disclosed embodiments, such various stages in disclosed methods, as described in greater detail above. Accordingly, such computer programs represent controllers of the computer system 300. When an embodiment is implemented using software, the software may be stored in a computer program product and loaded into computer system 300 using removable storage drive 312, interface 318, and hard disk drive 310, or communications interface 320. A computer program product may include any suitable non-transitory machine-readable (i.e., computer-readable) storage device having computer program instructions stored thereon.

Disclosed embodiments include a system and method for conducting a Baccarat game. Disclosed embodiments allow one or more alternative side bets and betting with one or more Variable Value Tokens (defined below). In such embodiments, a value of a Variable Value Token may be monitored, traced and stored using a system that includes a plurality of RFID-enabled chips, one or more antennas, and one or more processor circuits. Embodiments further provide a Baccarat game that is more entertaining for a user to play and that has a potential to increase revenue for a casino.

In general, a method for playing a modified Baccarat card game includes providing a gaming table or electronic gaming system. The gaming table or electronic gaming system includes a player hand area for receiving cards for a player hand, a banker hand area for receiving cards for a banker hand. The gaming table or electronic gaming system includes a gambling wager area having a player primary wager spot for receiving a wager on the player hand to win a Baccarat game, a banker primary wager spot for receiving a wager on the banker hand to win the Baccarat game, a Tie primary wager spot for receiving a wager on a tie between the banker hand and the player hand, and a side bet wager spot for receiving a Bigger Win side bet that either the player hand or the banker hand will have a higher point value based on a scoring system different from the rules of the Baccarat game. The method further includes receiving from a gambler on at least one of the wager spots, one or more Variable Value Tokens, the Variable Value Tokens having an initial face value that is more than the initial cost that was paid by the gambler.

Next stages include dealing the player hand in the player hand area and the banker hand in the banker hand area according to standard Baccarat rules, determining whether a winning hand in the Baccarat game is the player hand or the banker hand, and determining whether the winning hand in the Baccarat game is the same as the wager placed in the stage of receiving. Responsive to the outcome of the Baccarat game and according to predetermined rules for the Bigger Win side bet, a method includes determining whether the wager placed in the stage of receiving is a winning wager in the Baccarat game and on the Bigger Win side bet, and dispensing a payout according to a predetermined payout table if the wager placed in the stage of receiving is a winning wager. The gambler can redeem the Variable Value Tokens for a current monetary value, and the redemption of the Variable Value Tokens may be subject to one or more conditions.

An exemplary design for playing the modified Baccarat game according to the concepts of the present disclosure is shown by way of example in the accompanying drawing without attempting to show all the various forms and modifications in which the disclosure might be embodied, the disclosure being measured by the appended claims and not by the details of the specification.

Embodiments of the present disclosure relate to a modified Baccarat game. As used in this specification, and in the manner in which Baccarat is described, the terms "player" and "banker" are designations of the hands dealt in each round, and the outcomes that can be wagered upon. That is, "player has no particular association with any individual gambler, nor does "banker" have any particular association with the casino or dealer.

As used in the specification, the term "Baccarat" may be said to describe the standard punto banco form of Baccarat, all other varieties of Baccarat (for example, Mini-Baccarat, Midi-Baccarat, Chemin de Fer, Baccarat Banque) and all suitable forms described herein. That is, the side bets described herein may be utilized with any form of Baccarat, and with any other suitable casino gambling card game. The standard form of Baccarat may also be described herein as the "primary" Baccarat game.

As described below, the operations of the modified Baccarat game can be performed by (1) a human dealer in a casino gaming environment (for example, using the table design shown in FIG. 1 or FIG. 6) or (2) by a gaming machine communicating with a device used by the gambler (including a computerized betting terminal system allowing gamblers to play multiple and different live table games with a live dealer via remote terminals, or to play fully automatically without a live dealer) or (3) by an online gaming system where gamblers play on the internet via a computer, mobile device, or application. In either a gaming machine embodiment or an online gaming system embodiment, any utilized program code and modules implementing the functionality described herein are not native components of the underlying machine or system, and thus extend the operations and functionality thereof beyond their generic functions and capabilities. According to an embodiment, a gaming machine embodiment or an online gaming system embodiment may be connected via the internet.

Bigger Win Side Bet

A modified Baccarat game may include a Bigger Win side bet. The Bigger Win side bet provides an option for betting on whether the total value of the first two cards of the player hand or the first two cards of the banker hand for the standard Baccarat game will be higher. The determination of which hand is higher is based on rules different from the standard Baccarat rules. Cards with values 2 to 10 are worth their face value in points, Jack face cards are worth 11 points, Queen face cards are worth 12 points, King face cards are worth 13 points, and Ace's are worth 1 point. For example, the value of a hand having a 5 card and a King card is worth 18, which would beat a hand having a 2 card and a Queen card, which has a total value of 14. In some embodiments, a two card hand where the two cards match in numerical value, that is, form a pair, ranks higher than a non-paired hand. For example, a hand having a first 3 card and a second 3 card (otherwise having a value of 6) would beat a hand having a 2 card and a Queen card, which has a total value of 14. In some of these embodiments, paired hands are ranked based on the value of the individual cards; that is, a pair of Kings is the highest pair and a pair of Aces is the lowest pair. In other embodiments, a pair of Aces may be the highest pair.

The Bigger Win side bet may also include an option for the player to bet that the value or rank of the player hand and banker hand will be tied. For example, a tie bet would win if a first hand includes a 2 card and a 3 card and a second hand includes a 1 card and a 4 card, each hand having a value of 5. In some embodiments, the payout for a winning tie bet in the Bigger Win side bet is 11:1.

The outcome of the Bigger Win will be determined once the first two cards of the player hand and the first two cards of the banker hand for the standard Baccarat game are revealed. If, according to the standard Baccarat game rules, a third card needs to be drawn into either hand, a wager placed on the Bigger Win side bet may be resolved either before or after completing the primary Baccarat game.

It should be understood at least two cards may be dealt to each of the player hand and the banker hand in the present invention. The present invention includes one or more of the following outcomes of the wager and respective payouts:

(i) Banker Win on 6—when the total point value of the banker hand is higher than the total point value of the player hand by 6 points, the payout for the winning bet is 1:0.5;

(ii) Banker—when the total point value of the banker hand is higher than the total point value of the player hand, the payout is 1:0.9;

(iii) Player—when the total point value of the player hand is higher than the total point value of the banker hand, the payout is 1:0.9;

(iv) Bigger Banker—when the total point value of the first two cards of the banker hand is bigger than the total point value of the first two cards of the player hand, the payout is 1:0.9 with 10% commission to the casino;

(v) Bigger Player—when the total point value of the first two cards of the player hand is bigger than the total point value of the first two cards of the banker hand, the payout is 1:0.9 with 10% commission to the casino;

(vi) Tie—when the total point value of the player hand and the banker hand are equal, the payment is 1:8;

(vii) Bigger Tie—when the total point value of the first two cards of the player hand and the total point value of the first two cards of the banker hand are equal, the payout is 1:15;

(viii) Banker pair—when the point value of the first two cards of the banker hand are equal, the payout is 1:11;

(ix) Player Pair—when the point value of the first two cards of the player hand are equal, the payment is 1:11;

(x) Player Wins 2 Side—when the player hand satisfies the Bigger Player and Player Pair conditions; the payout is 1:20;

(xi) Player Wins 3 Side—when the player hand satisfies the Bigger Player, Player Pair and Player conditions, the payout is 1:50;

(xii) Banker Wins 2 Side—when the banker hand satisfies the Bigger Banker and Banker Pair conditions, the payout is 1:20; and (xiii) Banker Wins 3 Side—when the banker hand satisfies the Bigger Banker, Banker Pair and Banker conditions, the payout is 1:50.

Win Both Side Bet

In some embodiments, the Bigger Win side bet may include an option for a gambler to wager that he will win both the primary wager and the Bigger Win side bet on either the player hand or the banker hand. This may be referred to as a Win Both side bet. In order to place a wager on the Win Both side bet, the gambler is required to have placed the wagers on both the primary wager in Baccarat (i.e. player or banker) and the Bigger Win side bet on the same hand. The gambler wins the Win Both side bet if he wins both the primary Baccarat wager and the Bigger Win side bet, which will be for the same hand (i.e. both for the player hand or the banker hand) As an example, standard Baccarat payouts for the primary wager are 1:1 for player hand and 1:1 with a commission to the casino for the banker hand A Bigger Win side bet may also utilize the payout of 1:1 for player hand and 1:1 with a commission to the casino for the banker hand. For the Win Both side bet, the payout may be 2:1 or any other suitable rates above 2:1.

Variable Value Token

A modified Baccarat game may include the use of one or more Variable Value Tokens. A gambler pays a predetermined value, that is, an "initial cost," for the Variable Value Tokens. The total face value of the Variable Value Tokens is then determined by adjusting the initial cost paid by the gambler by a multiplier. In some embodiments, the total face value of the Variable Value Tokens is double the initial cost paid by the gambler. For example, when the gambler pays $100, the total face value of the Variable Value Tokens he receives will be $200. The multiplied face value of the Variable Value Tokens may be any suitable amounts. As said above, in certain examples, the multiplied face value may be 2:1. In some embodiments, the multiplied face value may be in a range of from 2:1 to 10:1. In other examples, the multiplied face value may be 10:1. The term or expression "Variable Value Tokens" used herein should be understood as including one or any number of tokens, chips, coins or the like. Each one of the Variable Value Tokens may be assigned any value, such as $5, $25, $100, $500, $1,000, $10,000, etc. In some embodiments, the Variable Value Tokens may be electronic. The Variable Value Tokens may then be used by a gambler to wager on the modified Baccarat game described herein. The Variable Value Tokens must be purchased and wagered by a gambler before dealing the modified Baccarat game. The Variable Value Tokens may be used on any of the available wagers in the modified Baccarat game.

The Variable Value Tokens may be redeemed for money after the gambler has played one or more rounds of the modified Baccarat game. In some embodiments, the gambler may be required to win a cumulative total value amount (that is, over the course of multiple games) that is a predetermined multiplier of the initial face value of the Variable Value Tokens (that is, a value 'turnover') before the Variable Value Tokens can be redeemed. In some embodiments, when redeeming the Variable Value Tokens, the gambler is not required to reimburse the casino for the multiplied face value that was realized upon purchasing the Variable Value Tokens. The Variable Value Tokens may be redeemed entirely for money at any subsequent face value, regardless of the initial face value.

This redemption of the Variable Value Tokens for money may be subject to one or more conditions. In some embodiments, the redemption of the Variable Value Tokens is subject to one or more of the following conditions:

1. Variable Value Tokens' Current Face Value: >200% of the Initial Face Value

When the gambler utilizes the Variable Value Tokens to play the modified Baccarat game and the Variable Value Tokens accumulate a current face value double or more than the initial face value of the Variable Value Tokens, the gambler may redeem the Variable Value Tokens for money for 100% of the current face value of the Variable Value Tokens. For example, the gambler pays $100 as an initial cost and receives Variable Value Tokens with a total initial face value of $200. After playing several rounds of the modified Baccarat game, the gambler has a net positive win and the Variable Value Tokens have accumulated a current face value of $400 (or above). In such instance, the gambler may opt to redeem the entirety of the current face value of the Variable Value Tokens for money in the equivalent value, i.e. $400.

2. Variable Value Tokens' Current Face Value: <200% of the Initial Face Value and >50% of the Initial Cost When the gambler utilizes the Variable Value Tokens to play the modified Baccarat game and the Variable Value Tokens accumulate a current face value that is between half of the initial cost of the Variable Value Tokens (that was paid by the gambler) and just less than double the initial face value of the Variable Value Tokens, the gambler may redeem the Variable Value Tokens for money for 50% of the current face value of the Variable Value Tokens. For example, the gambler pays $100 as an initial cost and receives Variable Value Tokens with a total initial face value of $200. After playing several rounds of the modified Baccarat game, the Variable Value Tokens have accumulated a current face value of between $50 and $400 (non-inclusive of the end points). In such instance, the gambler may opt to redeem the entirety of the current face value of the Variable Value Tokens for money equivalent to 50% of the current face value, i.e. $199.50 if the current face value is 3. Variable Value Tokens' Current Face Value: 50% and >0% of the Initial Cost When the gambler utilizes the Variable Value Tokens to play the modified Baccarat game and the Variable Value Tokens accumulate a current face value that is between zero and half (inclusive) of the initial cost of the Variable Value Tokens (that was paid by the gambler), the gambler may redeem the Variable Value Tokens for money for 100% of the current face value of the Variable Value Tokens. For example, the gambler pays $100 as an initial amount and receives Variable Value Tokens with a total initial face value of $200. After playing several rounds of the modified Baccarat game, the gambler has a net negative loss and the Variable Value Tokens have accumulated a current face value of between $0 (non-inclusive of the end point) and $50 (inclusive of the end point). In such instance, the gambler may opt to redeem the entirety of the current face value of the Variable Value Tokens for money in the equivalent value, i.e. $50 if the current face value is $50.

4. Lost all Value of the Variable Value Tokens

When the gambler utilizes the Variable Value Tokens to play the modified Baccarat game and the Variable Value Tokens are reduced to a current face value of zero, the gambler is not required to pay for the premium value received (that is, the multiplier of the initial cost) for the Variable Value Tokens. The gambler may choose to leave the game or purchase more Variable Value Tokens to play.

5. Rolling Chip Turnover 500% of the Variable Value Tokens' Initial Face Value

As said above, in some embodiments, the gambler may be required to win a cumulative total value amount (that is, over the course of multiple games) that is a predetermined multiplier of the initial face value of the Variable Value Tokens (that is, a value 'turnover') before the Variable Value Tokens can be redeemed. In certain embodiments, the turnover the gambler must win must be five times (or above) the initial face value of the Variable Value Tokens. Once this turnover is achieved, the gambler may then redeem the entirety of the current face value of the Variable Value Tokens for money for 100% of the current face value. For example, the gambler pays $100 as an initial cost and receives Variable Value Tokens with a total initial face value of $200. After playing several rounds of the modified Baccarat game, the gambler has wagered a total amount of $1,000 or above, and the current face value of the Variable Value Tokens is $300. In such instance, the gambler may opt to redeem the entirety of the current face value of the Variable Value Tokens for money in the equivalent value, i.e. $300.

6. Rolling Chip Turnover 600% of the Variable Value Tokens' Initial Face Value

In yet another embodiment, the turnover the gambler must win must be six times or above the initial face value of the Variable Value Tokens. Once this turnover is achieved, the gambler may then redeem the entirety of the current face value of the Variable Value Tokens for money for 100% of the current face value. In cases where the turnover is less than six times of the initial face value of the Variable Value Tokens, the gambler may then redeem half of the current face value of the Variable Value Tokens for money for 50% of the current face value.

In some embodiments, the redemption of the Variable Value Tokens is subject to one or more of the above conditions. Because the initial face value for the Variable Value Tokens is higher than the amount paid for the Variable Value Tokens, the Variable Value Tokens may have the effect of attracting additional gamblers to participate in the modified Baccarat game and increasing the level of excitement for the gamblers.

In some embodiments, using the Variable Value Tokens may require both a commission for a winning player hand wager and a higher commission for a winning banker hand wager (that is, higher than the standard 5% commission) to be paid to the casino. For example, using the Variable Value Tokens on a winning wager may require a commission of 10% for the player hand wager and 15% for the banker hand wager to be paid to the casino. Any suitable commission percentage higher than 0% for the player hand wager and the standard 5% for the banker hand may be utilized. In some embodiments, any suitable commission (e.g. 10%) may be required to be paid when the Variable Value Tokens are used for a winning side bet wager.

In Between Side Bet

A modified Baccarat game may include an In Between side bet. The In Between side bet provides an option for betting on whether a third card (when a third card is drawn in accord with the standard Baccarat rules) will be in between the first two cards of the player hand or the banker hand That is, the standard rules for Baccarat include drawing two initial cards for the player hand and two initial cards for the banker hand Based on the values of these initial cards, the standard rules for Baccarat sometimes call for additional cards to be drawn by the player, banker, or both. When a third card needs to be drawn for either or both of the player hand and the banker hand, a gambler may be given the option to bet whether the third card will fall in between the initial two cards. The gambler may bet that the third card will fall in between or that the third card will not fall in between the initial two cards. This side bet may be made for either or both of the player hand and the banker hand. This In Between side bet is made after the initial two cards of the player hand and the banker hand have been dealt. The payout amounts for a winning bet will be based the range between the initial cards.

In some embodiments, the payouts for the In Between side bet may be dispensed according to the following table.

| Range between the initial | Payout |
|---|---|
| 7-11 | 0.5:1 |
| 3-6 | 1:1 |
| 1-2 | 2:1 |

For purposes of this specification, the above described Bigger Win side bet, Win Both side bet, In Between side bet, and any combination thereof, may be referred to as "side bet," "a side bet," "the side bets," "each side bet," and "one or more side bets."

Method

A method of playing the modified Baccarat game is described as follows. The modified Baccarat game is initiated by the dealer calling for wagers, or by the gambler initiating a gaming round on a gaming machine, for example by depositing funds and selecting an option to start a game. This may be described as a first stage of receiving wagers from the gambler. A gambler can place one or more wagers for the game, including one or more of a primary wager on the outcome of the Baccarat hand and one or more of the side bets described herein. A gambler may utilize the Variable Value Tokens. The primary wager is made to participate in the primary Baccarat game. Any combination of the above described side bets may be utilized in a modified Baccarat game.

In certain embodiments, the gambler must make the primary wager on the standard Baccarat game to allow or otherwise be eligible to make the side bets. In one or more of these embodiments, the gambler can only place a side bet on the same hand as a primary wager had been placed. For example, in these embodiments, if the gambler makes a primary wager on the player hand, only a side bet can be placed on player, but if the gambler places a primary wager on a Tie, then a side bet can be placed on either the player or the banker.

In another version, a primary wager is required, but the gambler may make a side bet on either the player or banker hand. For example, the gambler can make a primary wager on the player hand to win, and a side bet on the banker hand. In other versions, the gambler may make one or more side bets without making any primary wager on the standard Baccarat game. After all gamblers have made their respective one or more primary wagers and side bet wagers, the method proceeds to dealing the player and banker hands according to the standard Baccarat rules, for example, according to the rules for punto banco Baccarat. This includes any rules for drawing cards by the player and banker hands, until the Baccarat rules indicate the entire hand is completed.

In some gaming machine or gaming system embodiments, a pseudo-random number generator (PRNG) integrated circuit may be used to select a random value, which is then used to select the cards from data structure (e.g., a stored data table, array, tree, linked list, tree, or other memory structure) stored in non-transitory computer memory representing a deck (or a plurality of decks) of cards available for dealing. Given the selected card (suit and value) a graphics processor coupled to the memory generates graphical symbols representing the selected cards, which are then selectively displayed on the display device. The pay tables may be programmatically encoded using stored data tables, conditional logic, or programmatic equivalents.

After the entire hand has been dealt, the outcome of the primary wager on the Baccarat hand is determined according to the Baccarat rules. Stated again, this can be done by the dealer, gaming machine, or online gaming system with corresponding program code modules implementing an algorithm that programmatically embodies the rules of Baccarat. In accord with standard Baccarat rules, for the primary wager, cards with values 2 to 9 may be worth their face value in points, face cards and 10's may be worth 0 points, and an ace may be worth 1 point.

The point totals for the player hand and banker hand are calculated to arrive at the final value of each hand. The hand with the greater final point value is the winning hand, and the results of the primary wager are determined based on which of the player hand and banker hand is the winning hand. A Tie would occur if the final point value of the player hand and the banker hand were the same. The outcomes are thus player wins, banker wins, or Tie. The primary wagers are then paid or collected according to the rules of Baccarat.

As described above, the Bigger Win side bet will be determined once the first two cards for both the player hand and the banker hand are revealed. Thus, the Bigger Win side bet may be paid or collected after the first two cards of the player hand and the banker hand are drawn, or after the standard Baccarat game is completed.

Similar to certain existing Baccarat games, in a modified Baccarat game a gambler may also be able to wager on whether the first two cards for both the player hand and the banker hand will be a matching pair. This wager may be paid out according to standard pay tables and may be paid or collected after the first two cards of the player hand and the banker hand are drawn, or after the standard Baccarat game is completed.

In accord with the modified Baccarat game, the outcomes of any offered side bets are determined, based on the features of the player hand and the banker hand corresponding to the side bets, and respective payouts are dispensed for winning wagers and respective side bet wagers are collected for losing wagers. Predetermined pay table amounts for the side bets may be utilized.

Table Design

Figure 6:
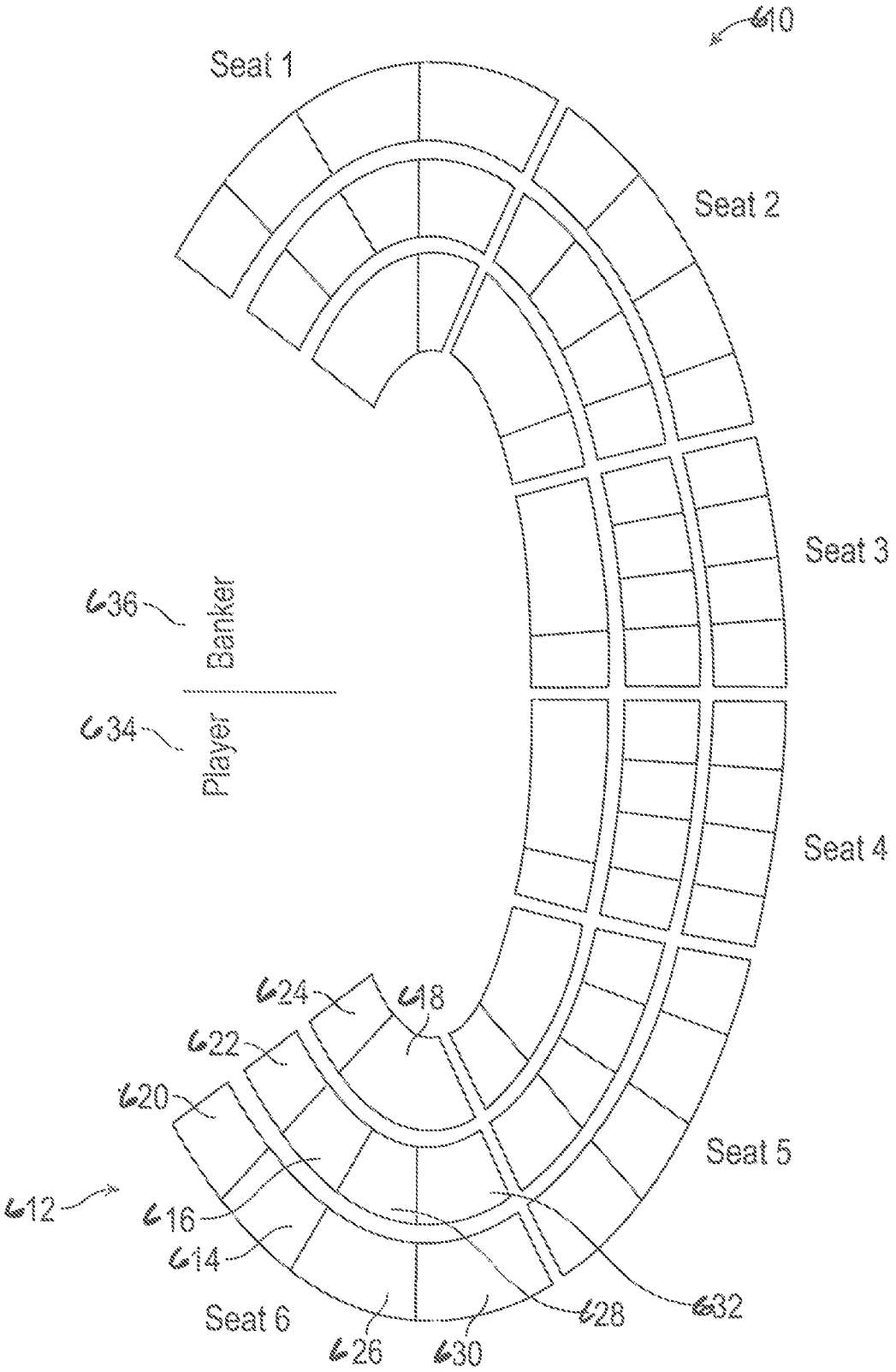
FIG. 6 is a schematic of a design for playing the modified Baccarat game, in accordance with an embodiment of the present disclosure.

As previously described, a modified Baccarat game according to concepts of the disclosure may be utilized as a table game or with a gaming machine or online gaming system. With reference to FIG. 6, a design 610, which may also be described as a gaming surface 610, is provided, which may be for a table of a table gaming embodiment or for a screen of a gaming machine or online gaming system. Design 610 may be printed on a table or may be part of a graphic for a gaming machine or online gaming system.

Gaming surface 610 includes a plurality of gambler locations 612 such that multiple gamblers may be a part of a single modified Baccarat game. Though FIG. 6 shows gaming surface 610 with six gambler locations 612, any suitable number of gambler locations 612 may be used. In certain embodiments, gaming surface 610 may include four gambler locations 612 or eight gambler locations 612. In other embodiments, a design for a modified Baccarat game may include only a single gambler location 612 particularly configured for a single gambler playing the modified Baccarat game.

Within gambler location 612, which may also be described as a gambling wager area 612, a gambler designates one or more wagers by placing chips or tokens in fixed, predetermined locations, which may also be described as wager spots. Gambling wager area 612 includes primary wager spots corresponding to the primary Baccarat game. This includes a player primary wager spot 614 for receiving a wager on the player hand to win a Baccarat game, a banker primary wager spot 616 for receiving a wager on the banker hand to win the Baccarat game, and a Tie primary wager spot 618 for receiving a wager on a tie between the banker hand and the player hand.

Gambling wager area 612 further includes wager spots for wagering on the Bigger Win side bet, as described above. This includes a Player Bigger Win wager spot 620 for receiving a wager on the player hand to win the Bigger Win side bet, a Banker Bigger Win wager spot 622 for receiving a wager on the banker hand to win the Bigger Win side bet, and a Tie Bigger Win wager spot 624 for receiving a wager on a tie between the banker hand and the player hand for the Bigger Win side bet. Gambling wager area 612 further includes wager spots for wagering on the Win Both side bet, as described above. This includes a player Win Both wager spot 626 for receiving a wager on the player hand to win the Win Both side bet, and a Banker Win Both wager spot 628 for receiving a wager on the banker hand to win the Win Both side bet.

Gambling wager area 612 further includes wager spots for wagering on the In Between side bet, as described above. This includes a player In Between wager spot 630 for receiving a wager on the In Between side bet for the player hand, and a banker In Between wager spot 632 for receiving a wager on the In Between side bet for the banker hand.

Though not shown with a particular wager location, a gambler may utilize the Variable Value Tokens with gambling wager area 612. In some embodiments, the Variable Value Tokens may be limited to wagering in player primary wager spot 614 and banker primary wager spot 616. In other embodiments, the Variable Value Tokens may be used for any wager spot within gambling wager area 612. For receiving cards for the modified Baccarat game, gaming surface 610 includes a player hand area 634 for receiving cards for a player hand and a banker hand area 636 for receiving cards for a banker hand.

Further details of primary Baccarat, gaming machine, and/or online gaming system embodiments may be disclosed in U.S. Pat. No. 9,950,246, which is incorporated herein by reference. For example, in gaming machine or online gaming system embodiments, the wagers are made by first selecting a number of credits available to the gambler from a credit balance on the gaming machine or gaming system. The wager spots would be provided on a user interface shown in a display device coupled to the gaming machine, or the gambler's client device. The gambler would use an input device (for example, mouse or touchscreen) to graphically manipulate and designate one or more wagers.

Figure 7:
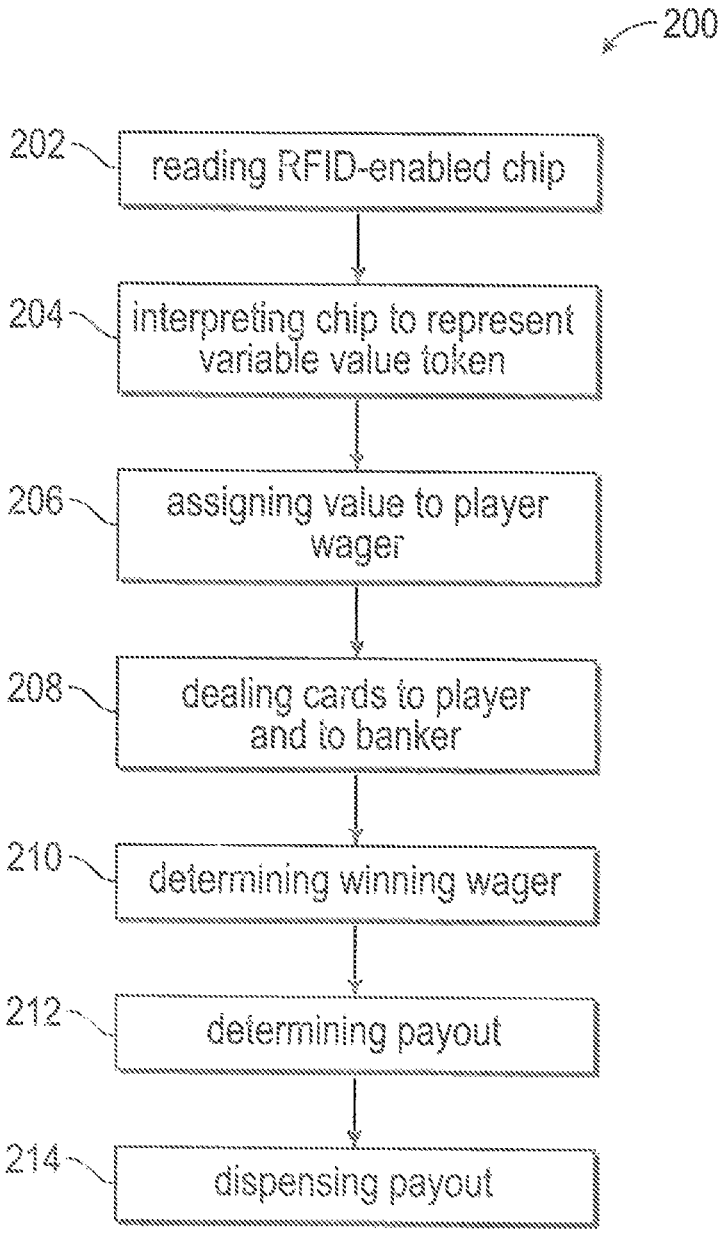
FIG. 7 is a flow chart illustrating a processor-implemented method, in accordance with an embodiment of the present disclosure.

FIG. 7 is a flow chart 200 illustrating a processor-implemented method, in accordance with an embodiment of the present disclosure. In a first stage 202, the method may include receiving, by a processor circuit, a signal from an antenna associated with a player position. The signal may be generated by a device configured to read an RFID-enabled chip. The device may generate a signal that may be received by the antenna. The method further includes determining that the signal corresponds to a unique identifier associated with an RFID-enabled chip. The RFID-enabled chip may be provided by a player and may represent a value of a Variable Value Token. In a further stage 204, the method may include interpreting the chip to represent a Variable Value Token having an initial face value that is more than an initial cost that was paid by the player.

In stage 206, the method may include assigning a value to a player wager to equal a value of one or more Variable Value Tokens. In stage 208, the method may include causing a card dealing device to deal a player hand in the player position and a banker hand in a banker position. Next, in stage 210, the method may include determining a winning wager. In this regard, the method may include determining whether the player hand or the banker hand is a winning hand, based on a predetermined set of rules, and further determining when the player wager is a winning wager. In stage 212, the method may include determining a payout according to predetermined rules. Lastly, in stage 214, the method may include dispensing the payout to the player.

In further embodiments, above-described methods of facilitating a card game may be implemented in a system in which antennas interact with chips having Radio Frequency Identification (RFID) tags. For example, an embodiment system may include a table apparatus, a card dealing device, a plurality of RFID-enabled chips, one or more antennas, and one or more processor circuits. The table apparatus may include a plurality of player positions and a banker position. The card dealing device may be configured to automatically deal cards to one or more players and to a banker. An antenna may be associated with a player position and the antenna may be configured to read a unique identifier associated with an RFID-enabled chip.

The processor circuit may be configured to communicate with the antenna and with the card dealing device and to control the card game by performing various operations. The operations may include causing the antenna to read the unique identifier associated with an RFID-enabled chip provided by a player. The operations may further include determining a type of chip provided by the player, based on the unique identifier, and interpreting the chip to represent a variable value token having an initial face value that is more than an initial cost that was paid by the player. The processor circuit may further assign a value to a player wager to equal the value of one or more variable value tokens and causing the card dealing device to deal a player hand in the player position and a banker hand in the banker position. The processor circuit may then determine whether the player hand or the banker hand is a winning hand based on a predetermined set of rules. The processor circuit may further determine when the player wager is a winning wager, and may then determine and dispense a payout according to predetermined rules.

Further details of the above-described systems including antennas and RFID-enabled chips are provided in U.S. Pat. Nos. 9,262,885; 9,694,272; and 9,919,201; the disclosure of each of which is incorporated herein by reference its entirety. The disclosed modified Baccarat game as described herein, in conjunction with the disclosed systems and methods of facilitating a card game, accomplishes the objects of the present disclosure and represents an improvement over existing systems and methods.

Embodiments may be implemented using software, hardware, and/or operating system implementations other than those described herein. Any software, hardware, and operating system implementations suitable for performing the functions described herein may be utilized. Embodiments are applicable to both a client and to a server or a combination of both.

The disclosure sets forth example embodiments and, as such, is not intended to limit the scope of embodiments of the disclosure and the appended claims in any way. Embodiments have been described above with the aid of functional building blocks illustrating the implementation of specified functions and relationships thereof. The boundaries of these functional building blocks have been arbitrarily defined herein for the convenience of the description. Alternate boundaries can be defined to the extent that the specified functions and relationships thereof are appropriately performed.

The foregoing description of specific embodiments will so fully reveal the general nature of embodiments of the disclosure that others can, by applying knowledge of those of ordinary skill in the art, readily modify and/or adapt for various applications such specific embodiments, without undue experimentation, without departing from the general concept of embodiments of the disclosure. Therefore, such adaptation and modifications are intended to be within the meaning and range of equivalents of the disclosed embodiments, based on the teaching and guidance presented herein. The phraseology or terminology herein is for the purpose of description and not of limitation, such that the terminology or phraseology of the specification is to be interpreted by persons of ordinary skill in the relevant art in light of the teachings and guidance presented herein.

The breadth and scope of embodiments of the disclosure should not be limited by any of the above-described example embodiments, but should be defined only in accordance with the following claims and their equivalents.

Conditional language, such as, among others, "can," "could," "might," or "may," unless specifically stated otherwise, or otherwise understood within the context as used, is generally intended to convey that certain implementations could include, while other implementations do not include, certain features, elements, and/or operations. Thus, such conditional language generally is not intended to imply that features, elements, and/or operations are in any way required for one or more implementations or that one or more implementations necessarily include logic for deciding, with or without user input or prompting, whether these features, elements, and/or operations are included or are to be performed in any particular implementation.

The specification and annexed drawings disclose examples of systems, apparatus, devices, and techniques that may provide control and optimization of separation equipment. It is, of course, not possible to describe every conceivable combination of elements and/or methods for purposes of describing the various features of the disclosure, but those of ordinary skill in the art recognize that many further combinations and permutations of the disclosed features are possible. Accordingly, various modifications may be made to the disclosure without departing from the scope or spirit thereof. Further, other embodiments of the disclosure may be apparent from consideration of the specification and annexed drawings, and practice of disclosed embodiments as presented herein. Examples put forward in the specification and annexed drawings should be considered, in all respects, as illustrative and not restrictive. Although specific terms are employed herein, they are used in a generic and descriptive sense only, and not used for purposes of limitation.

What is claimed is:

1. A system configured to facilitate a card game, the system comprising:

a table apparatus including a plurality of player positions, a banker position and at least one betting area;

a card dealing device configured to automatically deal cards to one or more players and to a banker;

a plurality of RFID-enabled chips;

at least one camera arranged to capture an image of the betting area;

at least one antenna associated with a player position, the antenna configured to read a unique identifier associated with an RFID-enabled chip;

a processing device configured to communicate with the at least one camera, the antenna and the card dealing device, and to analyze the image to identify at least one pile of chips based on diameters of the chips, to identify each chip from the identified at least one pile of chips based on heights of the chips, to identify a chip value of each of the identified chips based on color, and to calculate a total value of bets based on a sum of the chip values;

said processing device being configured to receive a signal from said at least one antenna and to determine whether the signal corresponds to a unique identifier associated with an RFID-enabled chip provided by a player and read by the antenna;

wherein the processing device is configured to determine an identity or value of said RFID-enabled chips according to the unique identifier or said image.

2. The system as claimed in claim 1, wherein the processing device further recognizes face values printed on the chips based on the image to determine the chip values.

3. The system according to claim 1, wherein said table apparatus further comprises at least one chip box associated with at least one of said player positions.

4. The system according to claim 3, wherein an RFID reader, in communication with said processing device, is arranged to read the unique identifier associated with a chip contained within said chip box.

5. The system as claimed in claim 4, wherein said processing device is configured to determine an authenticity of said chip contained within said chip box based on said unique identifier.

6. The system as claimed in claim 1, further comprising a plurality of monitors, disposed in a supervisor position, a dealer position and a player position on the table, wherein the monitors are configured to display chip counts and values.

7. The system as claimed in claim 6, wherein at least one of said monitors at a player position is an interactive panel.

8. The system according to claim 1, wherein the processing device is further configured to control the card game by performing operations including:

causing the antenna to read the unique identifier associated with an RFID-enabled chip provided by a player;

determining a type of chip provided by the player, based on the unique identifier;

interpreting the chip to represent a variable value token having an initial face value that is more than an initial cost that was paid by the player;

assigning a value to a player wager to equal the value of one or more variable value tokens;

causing the card dealing device to deal a player hand in the player position and a banker hand in the banker position;

determining whether the player hand or the banker hand is a winning hand based on a predetermined set of rules;

determining when the player wager is a winning wager;

determining a payout according to predetermined rules; and dispensing a payout when the player wager is the winning wager.

9. The system of claim 8, wherein the processor circuit is further configured to provide an option to the player to redeem a variable value token, wherein the variable value token is redeemed under one or more conditions, and wherein the one or more conditions comprises a first condition that the player redeems the variable value token for 100% of the current monetary value of the variable value token if the current monetary value of the variable value token is twice or more the initial face value of the variable value token, a second condition that the gambler redeems the variable value token for 50% of the current monetary value of the variable value token if the current monetary value of the variable value token is in a range of from more than half of the initial cost of the Variable Value Tokens (that was paid by the gambler) to less than twice the initial face value of the variable value token, and a third condition that the gambler redeems the variable value token for 100% of the current monetary value of the variable value token if the current monetary value of the Variable Value Tokens is equal to or less than half the initial cost of the variable value token (that was paid by the gambler) and more than zero.

10. The system of claim 8, wherein the processor circuit is further configured:

to determine that a variable value token has a zero value; and to provide an option to the player to:

allow the player to purchase one or more additional variable value tokens and continue playing; or allow the player to discontinue playing the game.

11. The system of claim 10, wherein the processor circuit is further configured to allow the player to purchase one or more additional variable value tokens at a cost that does not exceed the initial cost that was paid by the player.

12. The system of claim 8, wherein the processor circuit is further configured to provide an option to the player to redeem one or more variable value tokens for a value equal to a current monetary value of the one or more variable value tokens when a cumulative total amount won by the player is at least six times the initial face value of the one or more variable value tokens.

13. The system of claim 8, wherein the processor circuit is further configured to to interpret a value of one or more variable value tokens provided by the player to represent a Win Both wager, wherein the Win Both wager is a wager that that player will win both a primary wager and a Bigger Win wager on the player hand or that the player will win both the primary wager and a Bigger Win wager on the banker hand.

14. The system of claim 8, wherein the processor circuit is further configured to interpret a value of one or more variable value tokens provided by the player to represent an In-Between wager, wherein the In-Between wager is a wager that a third card drawn into the player hand or drawn into the banker hand will have a value in between two prior cards drawn into the player hand or drawn into the banker hand respectively.

15. The system of claim 8, wherein the processor circuit is further configured:

to determine a first commission for a winning banker hand, wherein the first commission percentage is any suitable rate predetermined by the house; and to determine a second commission for a winning player hand, wherein the second commission percentage is any suitable rate predetermined by the house.

16. The system of claim 1, wherein the processor circuit is further configured to interpret the chip to represent a variable value token having an initial face value that is at least double the initial cost that was paid by the player.

17. The system of claim 16, wherein the processor circuit is further configured to interpret the chip to represent a variable value token having an initial face value that is a multiple of the initial cost that was paid by the player, wherein the multiple is a factor in a range from 2 to 10.

18. The system of claim 1, wherein, when the processing device determines that payouts mismatch game rules through the camera, the processing device sends alerts to system managers and holds a game session until the card gaming system clears the alerts.

19. The system of claim 1, wherein the table has a docking hole at a player position, wherein the docking hole is embedded with a wireless communication system to report player information.

20. The system of claim 1, further comprising a light emitting module, disposed around each the betting areas, and lighting around one or more of the betting areas corresponding to a result of showdown.

* * * * *